US005885359A

United States Patent [19]

Tosio

[11] Patent Number: 5,885,359

[45] Date of Patent: Mar. 23, 1999

[54] DIFFUSION APPARATUS

[76] Inventor: Christopher Thomas Tosio, Box 456, Cramerview, South Africa, 2060

[21] Appl. No.: 953,702

[22] Filed: Oct. 17, 1997

[30] Foreign Application Priority Data

Oct. 18, 1996 [ZA] South Africa ..... 96/8799

[51] Int. Cl.[6] ..... C13D 1/02

[52] U.S. Cl. ..... 127/5; 127/6

[58] Field of Search ..... 127/5, 6

[56] References Cited

FOREIGN PATENT DOCUMENTS

| | | | |
|---|---|---|---|
| 30612 | 4/1926 | France | 127/5 |
| 2200795 | 7/1973 | Germany | 127/5 |
| 13012 | 5/1925 | Netherlands | 127/5 |

*Primary Examiner*—David Brunsman

*Attorney, Agent, or Firm*—Emch, Schaffer, Schaub & Porcello Co., L.P.A.

[57] ABSTRACT

A diffusion apparatus for use in the extraction of sugar cane juice from "prepared" sugar cane, comprises a lixiviation tank, a diffusion tank containing imbibition water and a conveyor for conveying the sugar cane from the lixiviation tank along a serpentine-like path through the diffusion tank. The diffusion tank has a rear end, a front end, two spaced sides and a base. The diffusion tank includes a plurality of spaced upright partition members which decrease in height in step-fashion from the rear end of the diffusion tank towards the front end thereof. Imbibition water is introduced into the diffusion tank at the rear end thereof and cascades towards the front end of the tank. Sugar cane is conveyed through the diffusion tank on support trays that are carried on chains along the serpentine-like path against the flow of imbibition water in the tank.

6 Claims, 2 Drawing Sheets

DIFFUSION APPARATUS

BACKGROUND OF THE INVENTION

This invention relates to a diffusion apparatus. It relates particularly to a diffusion apparatus for use in the extraction of sugar cane juice from "prepared" sugar cane.

Diffusion is an alternative to heavy duty milling as a method of extracting sugar cane juice from prepared sugar cane. As in the milling process, in the diffusion process "imbibition" water is added to aid extraction of the cane juice and essentially flows counter-current to the cane fiber to optimize the extraction of the sugar juice from the cane fibers.

Prior to either the milling or diffusion-extraction processes, sugar cane is typically "prepared" by knifing and/or shredding the cane stalks to expose the juice cells. In this regard, the term "preparation index" (P.I.) is often used in the sugar cane industry to describe a scale that defines the extent to which the sugar cane is knifed and/or shredded, with a high preparation index being indicative of a high degree of opened cells.

The process of diffusion used in the extraction of sugar juice from sugar cane is well-known and involves repeatedly washing "prepared" sugar cane with hot imbibition water.

The extraction of sugar cane juice in a diffusion apparatus occurs partly by the physical action of repeated washing and draining of the water by and from the prepared sugar cane, and partly due to the process of osmosis.

Diffusers are designed to extract sugar cane juice either from prepared cane (in which case it is called a "cane" diffuser) or from prepared cane that has been passed once through a sugar mill (in which case it is called a "bagasse" diffuser). For the purpose of this patent application there will be no differentiation between cane and bagasse diffusion.

The most successful known sugar cane diffuser in use is the "Egyptian" diffuser (also referred to as a "breadbox" diffuser). This type of diffuser is commonly used in the South African sugar industry which has the highest sucrose-extraction level of any sugar cane industry in the world, largely due to its having converted from milling to diffusion-extraction at most of its sugar factories.

Despite the high extraction levels obtained, the Egyptian diffuser has a number of disadvantages:

a) Egyptian diffusers are large in size (typically 65 meters in length) and therefore costly to construct. The width of the diffuser is proportional to the required throughput thereof and, as such, is generally between 4 and 12 meters wide.

b) In an Egyptian diffuser, the prepared cane is slowly moved over a perforated deck at a depth of typically 1.4 to 1.8 meters where it is repeatedly exposed to the washing action of the imbibition water. As such, an Egyptian diffuser has multiple stage-pumps, piping and distributors to recirculate the water/juice mixture which percolates through the bed of prepared cane.

c) If an Egyptian diffuser is installed in an existing factory, it is typically situated some distance from the initial preparation equipment and final processing equipment and invariably relatively lengthy and expensive conveyors are required to feed the diffuser and return the residual fiber.

d) If the preparation index of the cane is relatively high (typically>93%), the fines in the cane fiber have a tendency to "blind" the blanket of sugar cane, thereby inhibiting percolation and causing flooding on the surface of the cane bed which results in poor extraction. This is typically catered for by installing lifting screws to disturb the bed of cane at two or three places along the length of the diffuser. However, these lifting screws can be very troublesome and have been known to cause many stoppages.

e) Egyptian diffusers require regular monitoring to ensure optimum operation.

f) Egyptian diffusers and also other known diffusers require relatively high imbibition rates (typically 350 to 400% of the fiber flow rate). This in turn requires increased evaporation capacity in the final processing stage and increases steam demand from boilers. This can have serious financial implications when installing in an existing factory that typically uses low imbibition levels (100–200% on fiber).

Any reference hereinafter to sugar cane must be interpreted to include sugar beet. Furthermore, any reference hereinafter to prepared cane must be interpreted to mean, in the case of sugar cane, sugar cane that has been prepared by knifing and/or shredding sugar cane stalks, and in the case of sugar beet, sliced sugar beet.

It is an object of this invention to provide a diffusion apparatus that eliminates or avoids the disadvantages of the Egyptian Diffuser.

SUMMARY OF THE INVENTION

According to the invention there is provided a diffusion apparatus comprising:

a diffusion tank for containing imbibition water, having an operative front end, an operative rear end, two spaced sides extending between said front and rear ends and a base, the diffusion tank including a plurality of spaced operative upright partition members located between said front and rear ends of the diffusion tank, extending between the sides thereof, each partition member defining an operative upper and lower end, with the lower end thereof being spaced from the base of the diffusion tank; and conveying means for conveying prepared cane from the front end of the diffusion tank to the rear end thereof along a continuous serpentine-like path wherein the prepared cane is conveyed along spaces defined between each of adjacent partition members located in the diffusion tank.

The partition members may have configurations wherein the height thereof decreases in step-fashion toward the front end of the diffusion tank, thereby permitting imbibition water introduced, in use, into the rear end of the diffusion tank to cascade toward the front end thereof, causing imbibition water to flow in a direction opposite to the direction in which the prepared cane is operatively conveyed. In use, the counterflow direction of the imbibition water provides for optimum conditions for the extraction of sugar cane. In particular, when compared to the Egyptian diffuser, the use of multiple stage pumps as used in such diffusers to create counterflow conditions for the imbibition water through the prepared cane, is obviated.

The conveying means may comprise a continuous chain having a number of support elements for supporting prepared cane thereon, connected thereto, the chain following said serpentine-like path between the partition members of the diffusion tank and being in engagement with and supported by sprockets positioned at ends of the partition members.

The support elements may be in the form of perforated support trays defining configurations which permit sliding displacement of the trays in a substantially operatively horizontal configuration between each of adjacent partition members of the diffusion tank along said serpentine-like path. More particularly, the conveying means includes displacement means disposed above the partition members for turning over each support tray at operative upper ends of the partition members, thereby causing prepared cane on a particular support tray to be deposited onto the next support tray preceding it. In use, by turning over the prepared cane at the upper ends of the partition members, there is no possibility of fines accumulating between course fibers and affecting percolation of imbibition water through the perforated support trays.

The diffusion apparatus may include a separate lixiviation tank into which prepared cane can be fed prior to entering the diffusion tank. The lixiviation tank may includes heating means for heating liquid in the lixiviation tank to shock the juice cells of the prepared cane to open the fibers for more effective juice extraction.

In another embodiment of the invention, the diffusion tank may include heating means located at the front end thereof for shocking prepare cane upon entering the diffusion tank. In this embodiment, the need for a lixiviation tank as defined hereinabove, is obviated.

Further features of a diffusion apparatus in accordance with the invention are described hereinafter with reference to a non-limiting example of the invention, illustrated by way of the accompanying diagrammatic drawings.

DETAILED DESCRIPTION OF THE PREFERRED EMBODIMENTS

Figure 1:
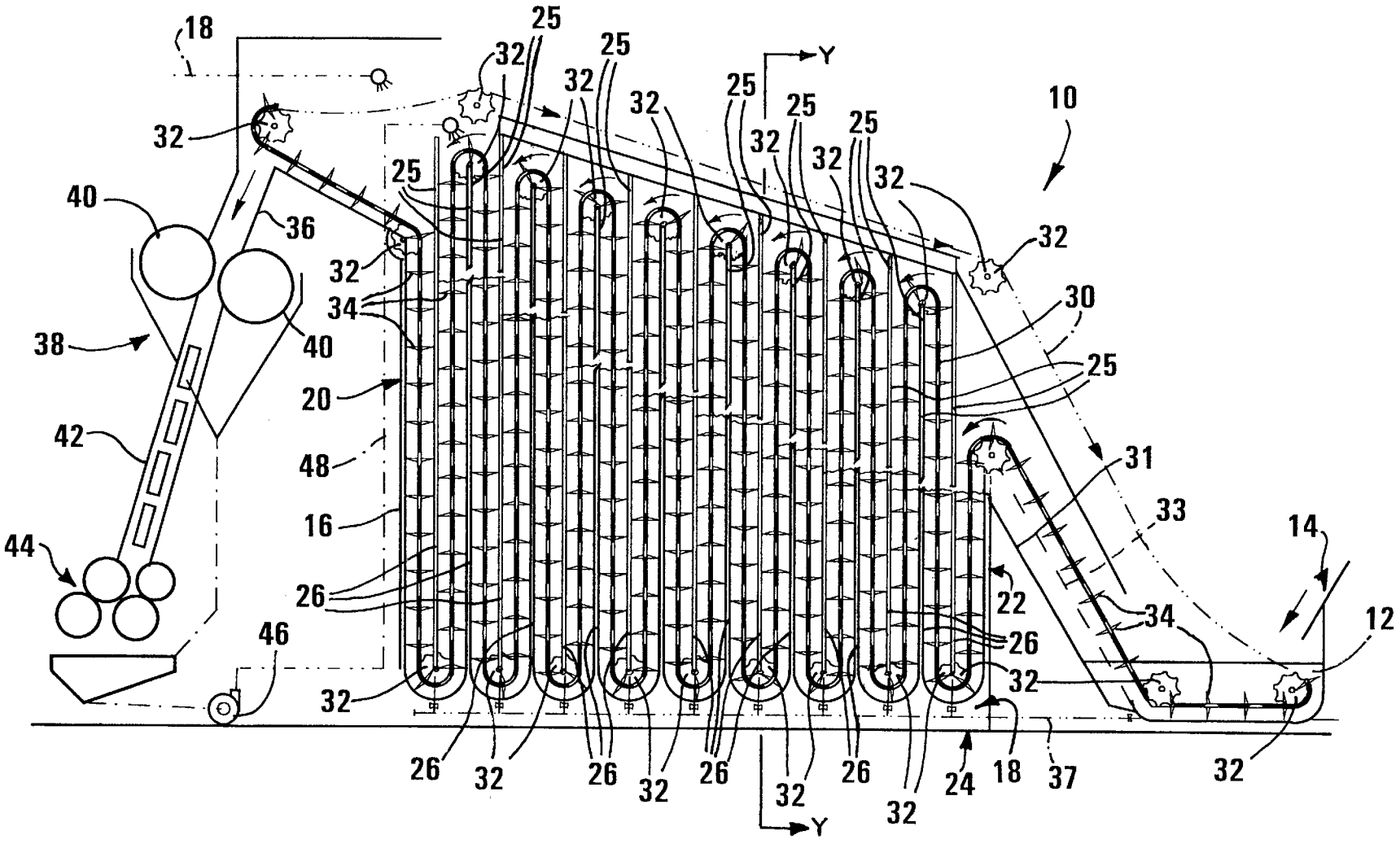
FIG. 1 shows a schematic sectional side elevation of a diffusion apparatus in accordance with the invention.
Figure 2:
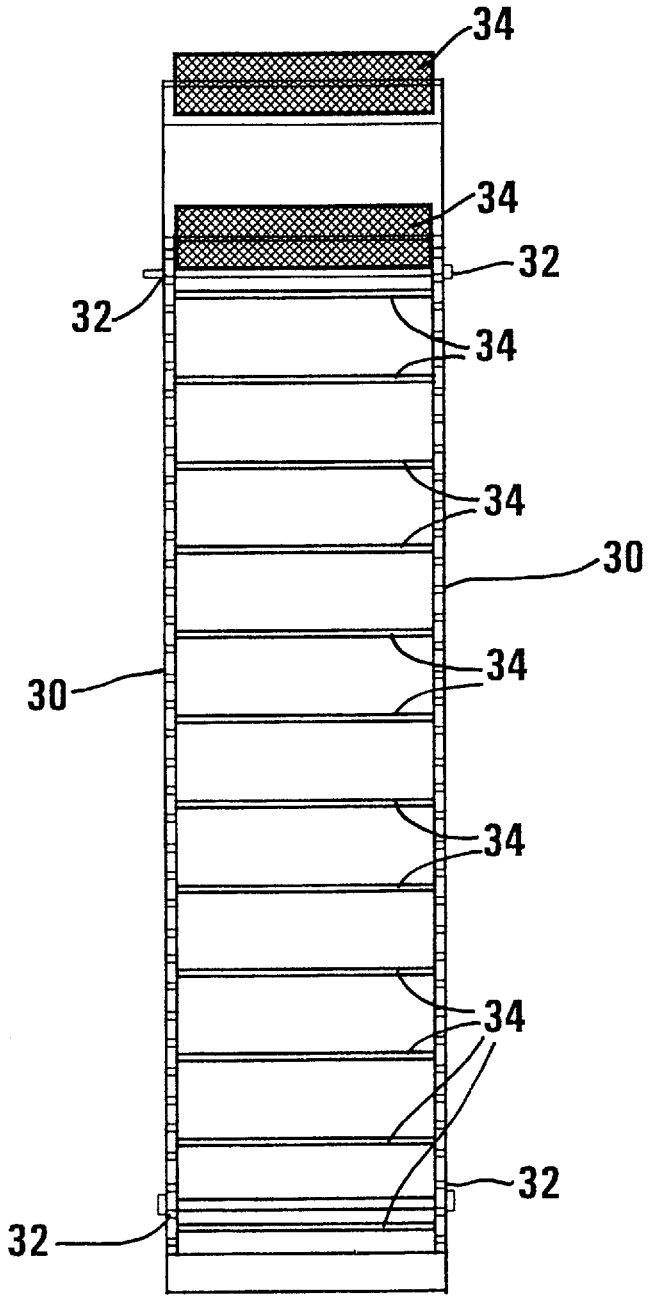
FIG. 2 shows a schematic sectional end view of the diffusion apparatus of FIG. 1, sectioned along section line Y—Y of FIG. 1.

With reference to the drawings, a diffusion apparatus in accordance with the invention, is designated generally by the reference numeral 10. The diffusion apparatus 10 is a cane diffuser and as such, comprises a lixiviation tank 12, a diffusion tank 16 containing imbibition water 18, and conveying means for conveying prepared cane from the lixiviation tank 12 to the diffusion tank 16 and along a predetermined path through the diffusion tank 16. Prepared cane is introduced into the lixiviation tank 12 via a chute 14 and thereafter transferred to the diffusion tank 16 by the conveying means.

The diffusion tank 16 defines an operative rear end 20, an operative front end 22, two spaced sides which extend between the front and rear ends and a base 24. The tank includes a plurality of spaced operatively upright partition members 26 located between the front and rear ends of the tank and extending between the sides thereof. Each partition member defines an operative upper and lower end, with the lower end of each partition member 26 being spaced from the base 24 of the tank.

The imbibition water is supplied hot (generally at a temperature in excess of 90° C.) into the tank 16 at the rear end thereof. Furthermore, the liquid in the lixiviation tank 12 is heated to "shock" the juice cells of the prepared cane introduced into the lixiviation tank. So-called "shocking" of the juice cells serves to open up the fibers of the prepared cane to thereby allow for more affective juice extraction. The heating of the liquid in the lixiviation tank 12 is substantially conventional and typically comprises heating the liquid via a direct injection of process vapor into the lixiviation tank 12 by means of so-called sparge pipes. Alternatively, heating may be provided by means of conventional heaters. The choice of heating arrangement will depend on steam conditions in the factory within which the diffusion apparatus 10 is installed.

The conveying means is in the form of a pair of continuous chains 30 which are in engagement with and supported by a number of sprockets 32 which are positioned at ends of the partition members. The chains 30 follow a continuous path from the lixiviation tank 12 to the diffusion tank 16, passing through the diffusion tank. More particularly, the chains 30 follow a continuous serpentine-like path along spaces defined between each of adjacent partition members 26, from their entry point at the front end 22 of the diffusion tank 16 until they exit at the rear end 20 thereof. The chains carry a number of support elements in the form of perforated support trays 34 for supporting prepared cane thereon (in FIG. 1 of the drawings, support trays 34 are depicted throughout the "wetted" path of the diffusion apparatus, with the return line being shown chain-dotted). The support trays 34 are pivotally connected at ends thereof, to the chains 30. More particularly, the support trays 34 define configurations which permit sliding displacement thereof in a substantially horizontal configuration between each of adjacent partition members 26 along said serpentine-like path.

The prepared cane is displaced by the chains 30 to the diffusion tank 16 along a ramp 31 having a perforated screen 33 which permits excess liquid in the cane to be returned to the lixiviation tank 12.

The diffusion apparatus 10 includes a plurality of upright guide elements 25 which extend operatively above each partition element 26, for guiding the support trays 34 along said serpentine-like path upon exiting from the imbibition water 18 in the tank 16.

The manner in which the support trays 34 are connected to the chains 30 provides for each support tray to be turned over when it reaches the uppermost point of its path of travel along a particular guide element 25, thereby causing prepared cane supported on the support tray to be turned over and deposited onto the next support tray preceding it. More particularly, the diffusion apparatus 10 includes a stop formation (not shown) located near the operative upper end of each guide element 25, against which side regions of the support trays 34 make contact when approaching the uppermost point of their path of travel, thereby causing the support trays to be turned over. In use, by turning over the prepared cane at the upper ends of the partition members, there is no possibility of fines accumulating between course fibers and affecting percolation of imbibition water through the mass of fiber.

The partition members 26 define configurations wherein the height of the partition members decreases in step-fashion from the rear end of the diffusion tank 16 towards the front end thereof. Accordingly, the height differential between the partition members permits imbibition water 18 introduced, in use, into the rear end of the diffusion tank 16 to cascade towards the front end thereof. This causes imbibition water to flow through the diffusion tank in a direction opposite to the direction in which the prepared cane is conveyed. This counterflow direction of the imbibition water in the diffusion tank 16 provides for optimum conditions for the extraction of sugar juice. Furthermore, the displacement of the imbibition water and the prepared cane in opposite directions provides for increased flow rate of the imbibition water relative to the prepared cane, thereby enhancing the extraction of sugar juice from the cane.

Sugar juice is drained from the diffusion tank 16 and transferred via a liquidation line 37, to a processing plant.

For the sake of completeness, after passing through the diffusion tank 16, the prepared cane is transferred via a chute 36 to a de-watering apparatus 38 comprising a pair of perforated rotating drums 40. Thereafter, the residual material (called "megasse") is transferred via a chute 42 to a drying mill designated generally by the reference numeral 44. The sugar juice extracted by the de-watering apparatus 38 is pumped back into the diffusion tank 16 via a pump 46 and along a conduit 48. As such, conveyors are not necessary to transfer the magasse to the drying mill.

An advantage of the diffusion apparatus 10 is that it is less expensive than the Egyptian diffuser to construct as it is considerably shorter and narrower for the same desired throughput. As such, it is envisaged by the Applicant that a typical diffusion apparatus in accordance with the invention shall be no more that 25 meters in length (compared to the Egyptian diffuser which typically is 65 meters in length).

A further advantage of the diffusion apparatus in accordance with the invention is that due to its smaller size it is envisaged by the Applicant that it will be able to be located between cane preparation equipment and drying mills, thereby obviating the need for additional conveyors to and from the diffusion apparatus.

Due to the counterflow of imbibition water created by the stepped configuration of the partition members to permit imbibition water to cascade from the rear end of the diffusion tank to the front end thereof, no stage pumps are required as is the case with, for example, the Egyptian diffuser.

A high preparation index of prepared cane will not present problems in the diffusion process where a diffusion apparatus in accordance with the invention is used, because prepared cane supported on the trays 34 is turned over at regular intervals as the prepared cane is conveyed along its serpentine-like path through the tank 16. As such, the diffusion apparatus 10 does not require periodic monitoring once optimum running conditions have been established.

A benefit of the diffusion apparatus 10 is that the total power required is expected to be less than 20% of that required by an equivalent Egyptian diffuser due to the need for stage-pumps and lifting screws being obviated and because of the use of lighter drives.

A further benefit of the diffusion apparatus 10 relates to the drainage of imbibition water and cane juice from the prepared cane in the diffusion process during "drainage" periods between the prepared cane being removed from the imbibition water and reintroduced into the water in the following "stage" while it is conveyed along said serpentine-like path through the diffusion apparatus. This repeated washing and drainage process leads to increased extraction efficiency of the drainage apparatus.

It is envisaged by the Applicant that the diffusion apparatus 10 will not require the same level of imbibition required by other known diffusers and should produce excellent extraction with 200 to 250% imbibition on fiber. It is also envisaged by the Applicant that cane processing factories with existing milling tandems and small evaporators will not have to make major changes to process equipment to incorporate the diffusion apparatus 10 into their cane juice extraction process.

It must be appreciated that the diffusion apparatus 10 is also suitable for extracting sugar juice from sliced sugar beet.

In summary, the Applicant believes that the diffusion apparatus in accordance with the invention provides an efficient and inexpensive diffuser for use in the extraction of sugar juice from prepared cane.

I claim:

1. A diffusion apparatus comprising:

a diffusion tank for containing imbibition water, having an operative front end, an operative rear end, two spaced sides extending between said front and rear ends and a base, the diffusion tank including a plurality of spaced operative upright partition members located between said front and rear ends of the diffusion tank and extending between the sides thereof, each partition member defining an operative upper and lower end, with the lower end thereof being spaced from the base of the diffusion tank, the height of the partition members decreasing in stepwise fashion towards the front end of the diffusion tank thereby permitting imbibition water introduced, in use, into the rear end of the diffusion tank to cascade toward the front end thereof, the diffusion tank defining a drainage space above said partition members, wherein periodic drainage of imbibition water from prepared cane can take place, in use; and conveying means for conveying prepared cane from the front end of the diffusion tank to the rear end thereof in an arrangement approximating perfect counter-plug flow of imbibition water and prepared cane, the conveying means being operable to convey prepared cane along a continuous serpentine-like path wherein the prepared cane is conveyed alternately through the imbibition water in the diffusion tank along spaces defined between each of adjacent partition members and the drainage space, thereby causing repeated dunking of the prepared cane in the imbibition water and drainage of imbibition water therefrom in the drainage space.

2. A diffusion apparatus as claimed in claim 1, wherein the conveying means comprises at least one continuous chain having a number of support elements for supporting prepared cane thereon, connected thereto, the chain following said serpentine-like path between the partition members of the diffusion tank and being in engagement with and supported by sprockets positioned at ends of the partition members.

3. A diffusion apparatus as claimed in claim 2, wherein the support elements of the conveying means are in the form of perforated support trays that define configurations which permit displacement of the rays in a substantially operative horizontal configuration between each of adjacent partition members of the diffusion tank along said serpentine path.

4. A diffusion apparatus as claimed in claim 3, wherein the conveying means includes displacement means disposed above the partition members for turning over each support tray at operative upper ends of the partition members, thereby causing prepared cane on a particular support tray to be deposited onto the next support tray preceding it.

5. A diffusion apparatus as claimed in claim 4, which includes a separate lixiviation tank into which prepared cane can be fed prior to entering the diffusion tank.

6. A diffusion apparatus as claimed in claim 5, wherein the lixiviation tank includes heating means for heating liquid in the lixiviation tank to shock the juice cells of the prepared cane to open the fibers for more effective juice extraction.

* * * * *

UNITED STATES PATENT AND TRADEMARK OFFICE

CERTIFICATE OF CORRECTION

PATENT NO. : 5,885,359
DATED : March 23, 1999
INVENTOR(S) : Christopher Thomas Tosio It is certified that error appears in the above-indentified patent and that said Letters Patent is hereby corrected as shown below:

Col. 6, line 50, delete "rays" and insert --trays--.

Signed and Sealed this

Twelfth Day of October, 1999

*Attest:*

Q. TODD DICKINSON

*Attesting Officer*

*Acting Commissioner of Patents and Trademarks*